US006653540B2

(12) United States Patent
Izen et al.

(10) Patent No.: US 6,653,540 B2
(45) Date of Patent: Nov. 25, 2003

(54) MECHANISM FOR SUPPORTING MUSICAL INSTRUMENTS

(75) Inventors: Mark S. Izen, Chestnut Hill, MA (US); Craig Small, Natick, MA (US); Alexander Webb, Wayland, MA (US); William Hester, Middletown, CT (US); Joseph Paul, Northfield, CT (US)

(73) Assignee: First Act, Inc., Newton, MA (US)

( * ) Notice: Subject to any disclaimer, the term of this patent is extended or adjusted under 35 U.S.C. 154(b) by 0 days.

(21) Appl. No.: 10/058,902

(22) Filed: Jan. 28, 2002

(65) Prior Publication Data

US 2003/0140766 A1 Jul. 31, 2003

(51) Int. Cl.[7] ..... G10D 13/02
(52) U.S. Cl. ..... 84/421; 84/327
(58) Field of Search ..... 84/421, 327, 411 R

(56) References Cited

U.S. PATENT DOCUMENTS 892,105 A * 6/1908 White ..... 248/60
5,645,253 A 7/1997 Hoshino
5,803,642 A * 9/1998 Sassmannshausen ..... 403/90
5,895,874 A * 4/1999 Liao ..... 84/421
5,973,248 A * 10/1999 Chen ..... 84/421
6,054,645 A 4/2000 Gauger
6,075,190 A 6/2000 Mosser et al.
6,093,878 A 7/2000 Hoshino

FOREIGN PATENT DOCUMENTS

GB 1154508 6/1969

* cited by examiner

*Primary Examiner*—Shih-Yung Hsieh
(74) *Attorney, Agent, or Firm*—John E. Toupal; Harold G. Jarcho

(57) ABSTRACT

A support mechanism adapted for connection to a stand member, and for holding an instrument support arm in a desired position relative to the stand member, includes a receiving member adapted with a first receiving feature for receiving the stand member. A first receiving feature is a through hole adapted for variable positioning along the stand member. The receiving member is further adapted with a second receiving feature for receiving a ball member to form a ball joint. The ball member includes a third receiving feature for receiving the support arm. The third receiving feature is a through hole adapted for variable positioning along the support arm. The stand member and support arm are cooperatively connected through the ball joint.

15 Claims, 8 Drawing Sheets

MECHANISM FOR SUPPORTING MUSICAL INSTRUMENTS

FIELD OF THE INVENTION

The present invention relates to a mechanism that supports a musical instrument such as a conventional drum and is capable of being universally adjusted so that the instrument is at a height and angular orientation that is optimal for the performer.

BACKGROUND AND OBJECTS OF THE INVENTION

Conventional stands for supporting musical instruments such as drum components require that each instrument has a support post that is linked to a dedicated stand through height and tilt adjustment controls so that a performer can adjust each drum to a desired height and angular orientation. Such mechanisms are disclosed in U.S. Pat. Nos. 5,645,253; 6,054,645; 6,075,190; 6,093,878; and British Patent No. 1,154,508. Significant functional disadvantages to prior art support mechanisms such as these are rooted in the physical limitations of tilt mechanisms and in the overall structures that force the use of individual stands for each instrument. The time required to properly position all instruments is burdensome even when proper positioning is possible, and many duplicate components are required.

It is therefore an object of the present invention to overcome the problems encountered with conventional support stands and provide a support mechanism for musical instruments that allows the performer to support a plurality of instruments from a single stand.

It is thereby an object to provide such a support mechanism that reduces the number of components and costs associated with conventional uses.

It is a further object to provide such a support mechanism that is adapted for quickly and easily adjusting both the height and the angular position of each instrument.

It is a further object to provide such a support mechanism that allows the user to adjust the height and tilt of each instrument into the optimal position.

It is a further object to provide such a support mechanism that may be affixed to stand members that are at any orientation, including horizontal and vertical.

A further object of the present invention is to provide a more convenient adjustment control for a musical instrument support.

SUMMARY OF THE INVENTION

The present invention is a support mechanism adapted for connection to a stand member, and for holding an instrument support arm in a desired position relative to the stand member.

The support mechanism includes a receiving member adapted with a first receiving feature for receiving the stand member. The first receiving feature is a through hole adapted for variable positioning along the stand member. The receiving member is further adapted with a second receiving feature for receiving a ball member to form a ball joint.

The ball member includes a third receiving feature for receiving the support arm. The third receiving feature is a through hole adapted for variable positioning along the support arm. The stand member and support arm are cooperatively connected through the ball joint.

The receiving features are each adapted with individually operable clamps. The first clamp of the first receiving feature is adapted to grip the stand member and to allow or deny rotational and longitudinal motion of the receiving member relative thereto. The second clamp of the second receiving feature is adapted to grip the ball member and to allow or deny pivotal motion of the receiving member relative thereto. The third clamp of the third receiving feature is adapted to grip the support arm and to allow or deny rotational and longitudinal motion of the ball member relative thereto.

Each clamp is adapted with a release/lock mechanism to allow motion when in its released position and to deny motion when in its locked position.

When the first release/lock mechanism is released, longitudinal adjustment of the receiving member along the stand member and rotational adjustment of the receiving member around the stand member is enabled. Locking the first release/lock mechanism rigidly secures the receiving member in the selected position relative to the stand member.

When the second release/lock mechanism is released, universal pivoting adjustment of the receiving member relative to the ball member is enabled. Locking the second release/lock mechanism rigidly secures the receiving member in the selected position relative to the ball member.

When the third release/lock mechanism is released, longitudinal adjustment of the ball member along the support arm is enabled. Locking the third release/lock mechanism rigidly secures the ball member in the selected position relative to the support arm.

The receiving member is comprised of two identical and mating halves, which minimizes the number of differing components that must be manufactured and inventoried. This provides an economic as well as a manufacturing advantage.

Each receiving member half includes contoured inner surfaces which cooperate when the two halves are connected to form the first and second receiving features. Together, the two halves cause a gap that provides for the first and second clamps.

The overall shape and configuration of the support mechanism provides for the ganging of a multitude of such mechanisms in side-by-side fashion along one stand member, each mechanism being individually positioned and locked to provide for optimal positioning of a multitude of instruments, all supported from a single stand.

Other features and advantages of the present invention will become apparent from the following description of the invention that refers to the accompanying drawings.

BRIEF DESCRIPTION OF THE DRAWINGS

For a fuller understanding of the nature and objectives of the invention, reference should be made to the following detailed description, taken in conjunction with the accompanying drawings.

DETAILED DESCRIPTION OF THE PREFERRED EMBODIMENT

Figure 1:
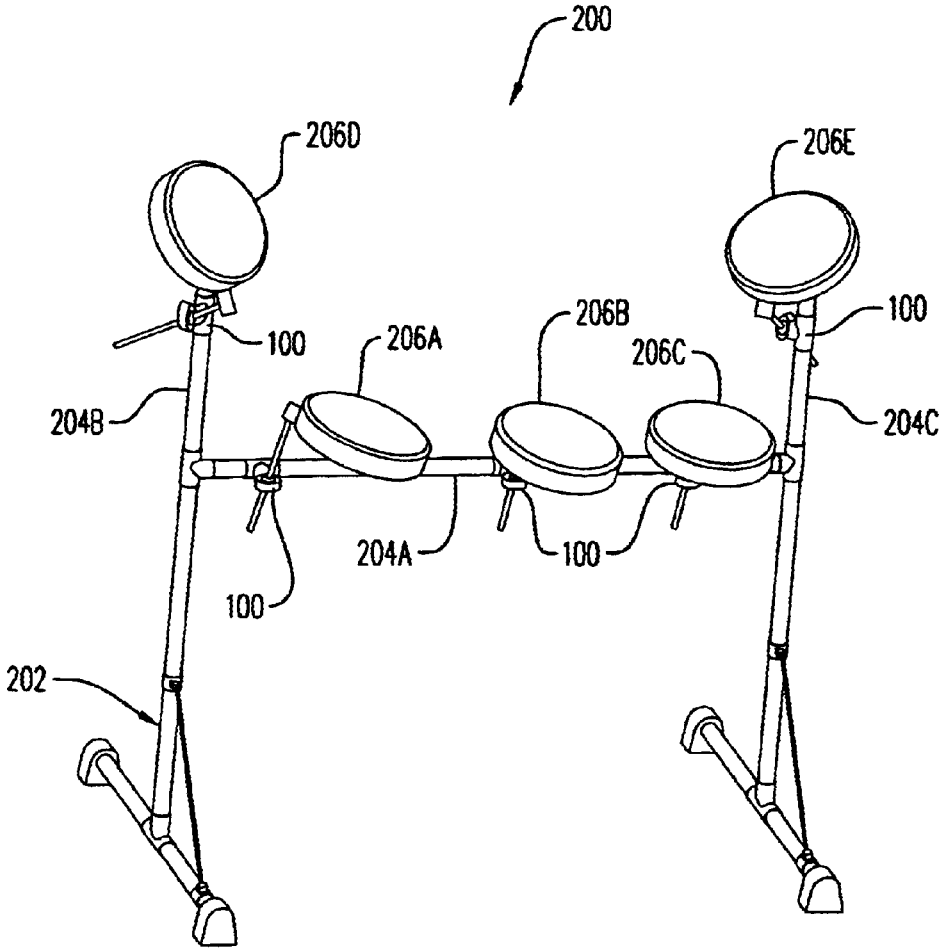
FIG. 1 is a perspective view of a drum set support stand having a plurality of drums, each drum attached to the support stand via mounting mechanisms in accordance with the preferred embodiment of the invention.

Referring to FIG. 1, a drum set 200 has a support stand 202 with horizontal cylindrical stand member 204A, to which are affixed three drum heads 206A, 206B and 206C, and with vertical stand members 204B and 204C to each of which are affixed one of two drum heads 206D and 206E, all via mounting mechanisms 100 according to the preferred embodiment of the invention.

Figure 2:
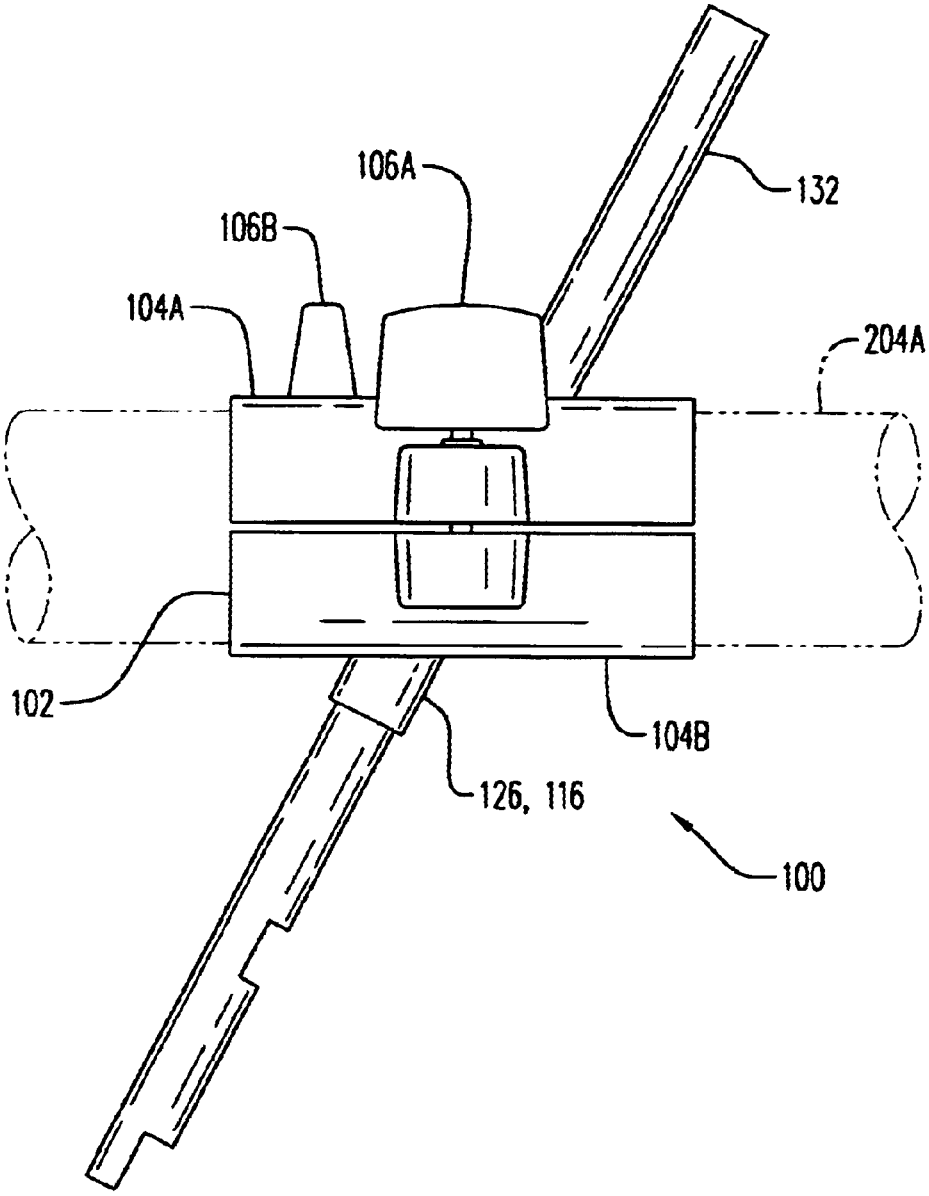
FIG. 2 is a front view of a mounting mechanism in accordance with the preferred embodiment.
Figure 3:
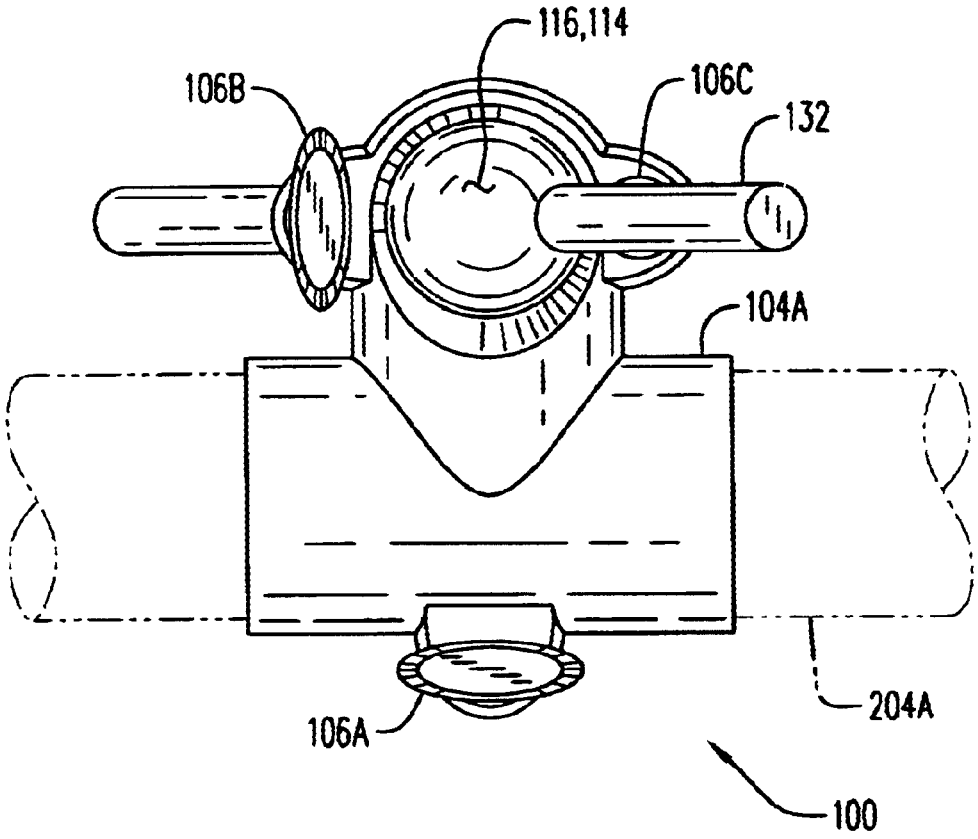
FIG. 3 is a top view of the mechanism of FIG. 2.
Figure 4:
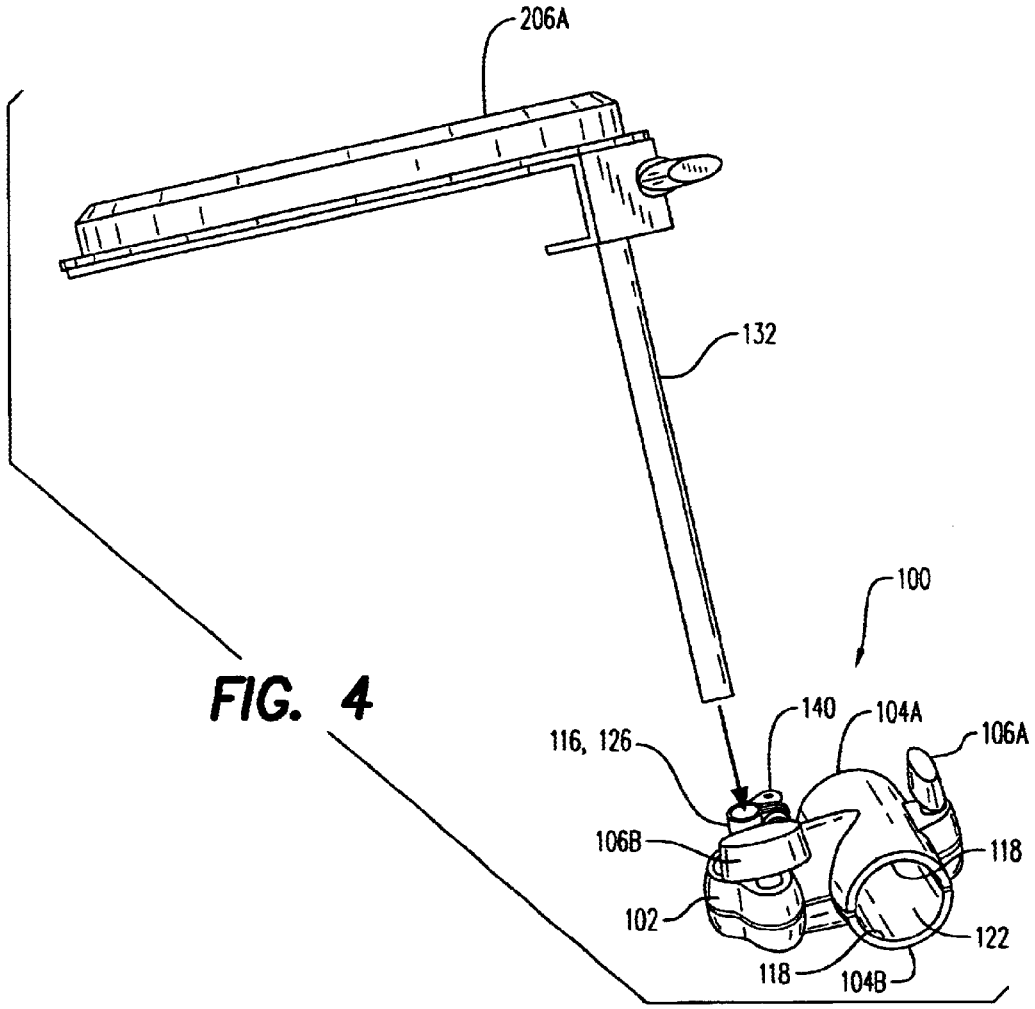
FIG. 4 is a perspective view of the mechanism of FIG. 2 with a drumhead being inserted thereinto.

Individual mounting mechanism 100 is shown in FIGS. 2 through 4 attached to horizontal stand member 204A by example, with components shown in FIGS. 5 through 12.

Receiving member 102, is comprised of identical housing halves, top half 104A and bottom half 104B, shown separately in FIGS. 6 through 10, which are held together by thumb screws 106A and 106B, and by machine screw 106C that pass through holes 108A, 108B and 108C from the top housing half 104A, through bottom housing half 104B, and into mating nuts. Each half 104A and 104B is adapted with semi-cylindrical recess 118 so that when the halves are mated together, a cylindrical through hole first receiving portion 122 is formed for accommodating and gripping the cylindrical stand members 204A, 204B or 204C of the support stand 202. Each housing half also is adapted with semi-spherical recess 110 so that when the halves are mated together, a spherical socket is formed for accommodating spherical ball 114 of ball member 116.

Figure 5:
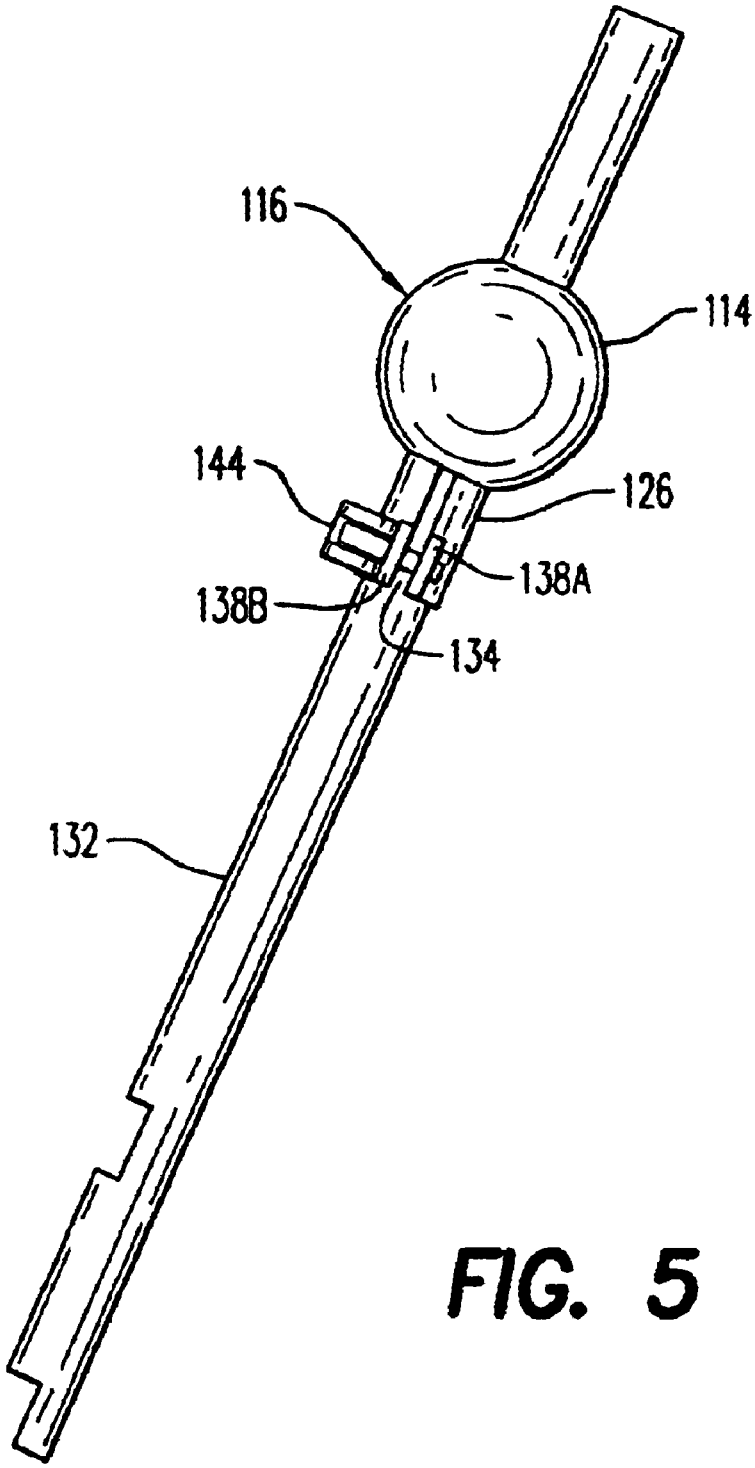
FIG. 5 is a side view of the ball member/support arm subassembly of the mechanism of FIG. 2.
Figure 6:
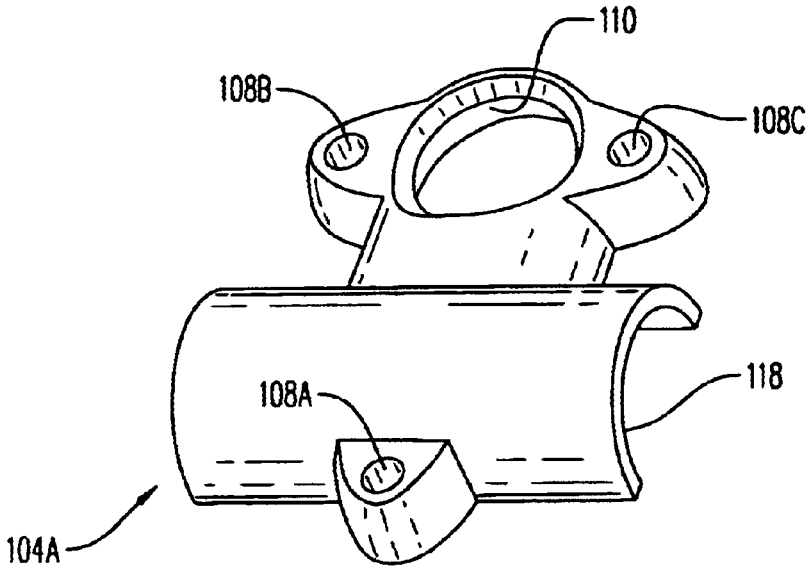
FIG. 6 is a top, right perspective view of the top housing half of the mechanism of FIG. 2.
Figure 7:
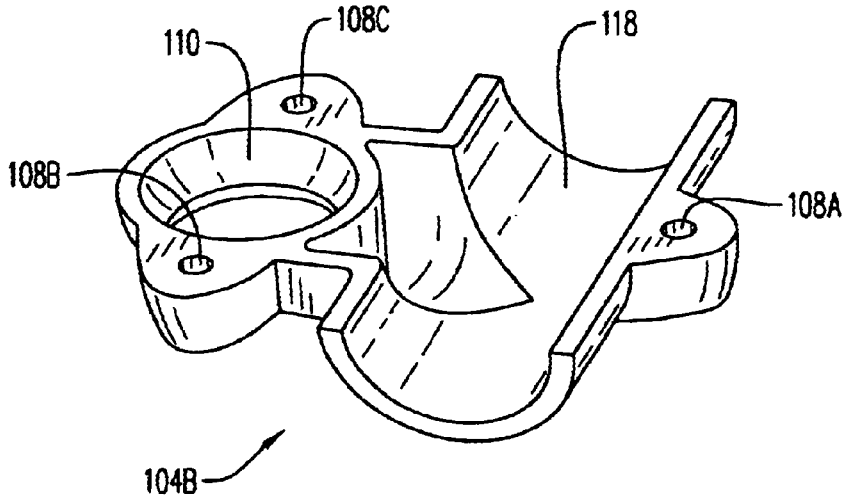
FIG. 7 is a top, left perspective view of the bottom housing half of the mechanism of FIG. 2.
Figure 8:
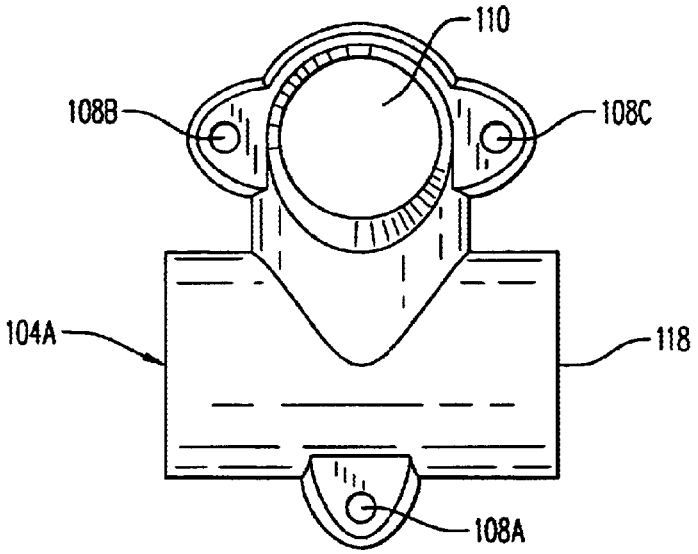
FIG. 8 is a top view of the top housing half of the mechanism of FIG. 2.
Figure 9:
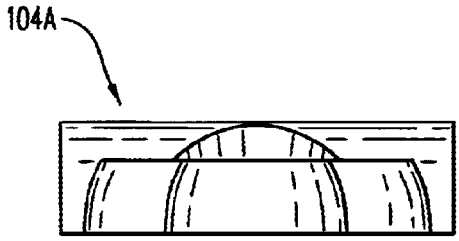
FIG. 9 is a rear view of the top housing half of FIG. 8.
Figure 10:
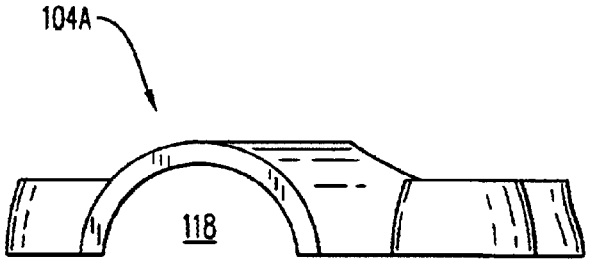
FIG. 10 is a right end view of the top housing half of FIG. 8.
Figure 11:
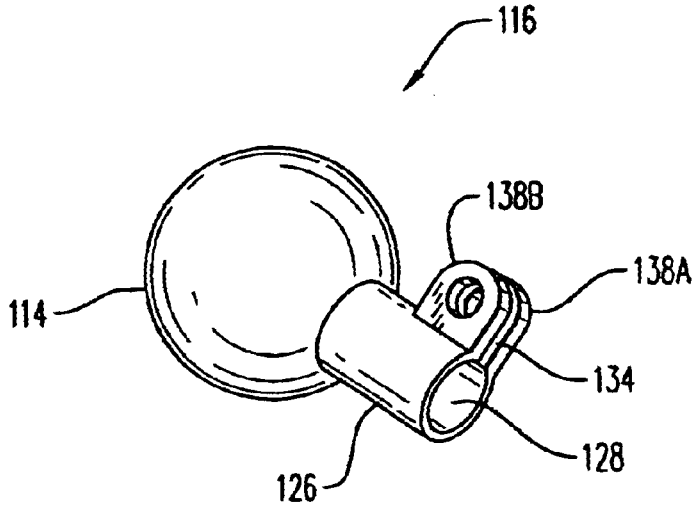
FIG. 11 is a perspective view of the ball member of the mechanism of FIG. 2.
Figure 12:
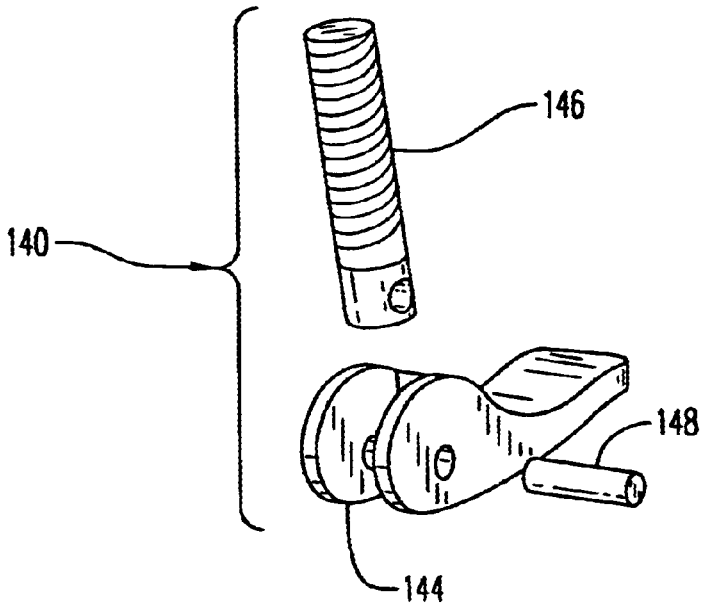
FIG. 12 is an exploded view of a clamp of the mechanism of FIG. 2.

Ball member 116, shown in FIGS. 5 and 11, comprises cylindrical neck portion 126 extending radially from ball 114, with cylindrical through hole opening 128 passing through the centers of both the ball 114 and neck 126 forming a third receiving portion for accommodating and gripping a cylindrical support arm 132, as shown in FIG. 5. Neck portion 126 is adapted with slot 134 and ears 138A and 138B for accommodating clamp mechanism 140, shown separately in FIG. 12.

Referring again to FIG. 4, it can be seen that loosening of first securing thumbscrew 106A releases the grip of the receiving member 102 on stand member 204A so that the receiving member is free to rotate about and slide longitudinally along the stand member. Retightening thumbscrew 106A locks the receiving member 102 to the stand member at the selected position.

Loosening of second securing thumbscrew 106B releases the grip of the receiving member 102 on ball 114 so that the ball may pivot freely and universally within the spherical recess of receiving member 102. Support arm 132 is thus free to be pivoted about the mechanism. Retightening thumbscrew 106B locks the support arm 132 in its selected angular position.

Third securing clamp mechanism 140 is comprised of cam lever 144, which is pivotally affixed to lock pin 146 by roll pin 148. Lifting cam lever 140 releases the grip of neck 126 on support arm 132 so that the support arm is free to be rotated within and slid longitudinally relative to the ball member 116, and therefore the support mechanism 100. Pressing the cam lever 144 back down into its original position locks the support arm 132 in its selected longitudinal position.

As can be seen in FIG. 1, it is possible to arrange numerous mechanisms 100 and drums along stand members 204A, 204B and 204C because the cylindrical through holes 122 provide for the side-by-side positioning of the receiving members 102 along the stand members.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A mechanism for connection to a stand member and for supporting a musical instrument in a selectable position relative thereto, said mechanism comprising:

a receiving means, a ball member, and a support arm adapted for connection to the musical instrument;

said receiving means comprising a first receiving portion for mounting on the stand member; and a second receiving portion for receiving said ball member to form a universally pivotal ball joint;

said ball member defining a through hole for receiving said support arm, and wherein the stand member and said support arm are connected via said mechanism, and the relative positions thereof are adjustable via sliding movement of said support arm in said hole and rotational movement of said ball joints;

a first securing means for actuating said first receiving portion to allow or deny rotational and longitudinal motion thereof relative to the stand member; and a second securing means operable independently of said first securing means for actuating said second receiving portion to allow or deny universally pivotal motion thereof relative to said ball member.

2. The mechanism of claim 1 wherein said first securing means comprises:

a first release mode to allow said rotational and longitudinal motion of said first receiving portion relative to the stand member;

a first lock mode to deny said rotational and longitudinal motion of said first receiving portion relative to the stand member;

said second securing means comprises:

a second release mode to allow said universally pivotal motion of said ball member relative to said second receiving portion; and a second lock mode to deny said universally pivotal motion of said ball member relative to said second receiving portion.

3. The mechanism of claim 1 wherein said ball member comprises a third receiving portion and a third securing means operable independently of said first and second securing means for actuating said third receiving portion to allow or deny longitudinal motion thereof relative to said support arm.

4. The mechanism of claim 3 wherein said first securing means comprises:

a first release mode to allow said rotational and longitudinal motion of said first receiving portion relative to the stand member;

a first lock mode to deny said rotational and longitudinal motion of said receiving portion relative to the stand member;

said second securing means comprises:

a second release mode to allow said universally pivotal motion of said ball member relative to said second receiving portions;

a second lock mode to deny said universally pivotal motion of said ball member relative to said second receiving portion; and said third securing means comprises:

a third release mode to allow said longitudinal motion of the support arm relative to said ball member; and a third lock mode to deny said longitudinal motion of the support arm relative to said ball member.

5. A mechanism for supporting a musical instrument in a selectable position said mechanism comprising:

a receiving member, a ball member, and a support arm adapted for connection to the musical instrument;

said receiving member comprising a ball receiving portion for receiving said ball member to form a universally pivotal ball joint;

said ball member comprising an arm receiving portion for receiving said support arm, and wherein said support arm is universally adjustable via said ball joint and longitudinally adjustable via said arm receiving portion;

one securing means adjustable to allow or deny universally pivotal motion of said ball receiving portion relative to said ball member; and another securing means adjustable independently of said one securing means to allow or deny longitudinal movement of said arm relative to said arm receiving portion.

6. A mechanism according to claim 5 wherein said one securing means is a ball clamp adjustable to force said ball receiving portion into gripping engagement with said ball member.

7. A mechanism according to claim 6 wherein said another securing means is an arm clamp adjustable independently of said ball clamp to force said arm receiving portion into gripping engagement with said arm member.

8. A mechanism according to claim 5 wherein said arm receiving portion is defined by a hole through said ball member and an opening formed by a neck portion of said ball member and axially aligned with said hole.

9. A mechanism according to claim 8 wherein said one securing means is a ball clamp adjustable to force said ball receiving portion into gripping engagement with said ball member.

10. A mechanism according to claim 9 wherein said another securing means is an arm clamp adjustable independently of said ball clamp to force said neck portion into gripping engagement with said arm member.

11. A mechanism according to claim 8 wherein said another securing means is a clamp adjustable to force said neck portion into gripping engagement with said arm member.

12. A mechanism according to claim 5 wherein said ball member is a one piece ball defining a central located through hole.

13. A mechanism according to claim 12 wherein said arm receiving portion is defined by said hole through said ball member and an opening formed by a neck portion of said ball member and axially aligned with said hole.

14. A mechanism according to claim 13 wherein said one securing means is a ball clamp adjustable to force said ball receiving portion into gripping engagement with said ball member.

15. A mechanism according to claim 14 wherein said another securing means is an arm clamp, adjustable independently of said ball clamp to force said neck portion into gripping engagement with said arm member.

* * * * *